US012066236B2

(12) United States Patent
Henderson et al.

(10) Patent No.: US 12,066,236 B2
(45) Date of Patent: Aug. 20, 2024

(54) ICE SHAPING DEVICE

(71) Applicant: E. & J. Gallo Winery, Modesto, CA (US)

(72) Inventors: William L. Henderson, Maplewood, NJ (US); Jimmy Chu, Park Ridge, NJ (US)

(73) Assignee: E. & J. Gallo Winery, Modesto, CA (US)

( * ) Notice: Subject to any disclaimer, the term of this patent is extended or adjusted under 35 U.S.C. 154(b) by 62 days.

(21) Appl. No.: 16/416,651

(22) Filed: May 20, 2019

(65) Prior Publication Data

US 2019/0353415 A1 Nov. 21, 2019

Related U.S. Application Data

(60) Provisional application No. 62/674,272, filed on May 21, 2018.

(51) Int. Cl.
*F25C 5/14* (2006.01)

(52) U.S. Cl.
CPC ..... *F25C 5/14* (2013.01)

(58) Field of Classification Search
CPC ..... F24C 5/14; F25C 1/22; F25C 1/25; F25C 1/04; F25C 1/045; F25C 1/006
See application file for complete search history.

(56) References Cited

U.S. PATENT DOCUMENTS 1,263,141 A * 4/1918 Strauss ..... B29C 33/18 264/553
1,342,184 A * 6/1920 Rauer ..... D21J 5/00 162/408
1,612,651 A * 12/1926 Roberts ..... B29C 65/7441 264/572
2,030,735 A * 2/1936 Beishaw ..... F25C 5/14 62/320
2,127,262 A * 8/1938 La Casse ..... F25C 5/14 62/320
2,804,653 A * 9/1957 Talalay ..... B29C 44/3415 264/28
3,048,988 A * 8/1962 Nelson ..... F25C 1/045 62/347
3,365,764 A * 1/1968 Wall ..... B29C 43/00 425/392
8,882,489 B1 * 11/2014 Coomer ..... F25C 5/14 425/407
2004/0206250 A1 * 10/2004 Kondou ..... F25C 5/14 99/426
2014/0047859 A1 * 2/2014 Schwulst ..... F25C 5/08 62/340
2014/0167321 A1 * 6/2014 Culley ..... F25C 1/04 264/319
2015/0367536 A1 * 12/2015 Compton ..... F25C 5/14 425/218
2019/0264970 A1 * 8/2019 Tarr ..... F25C 5/14

* cited by examiner

*Primary Examiner* — Tavia Sullens
(74) *Attorney, Agent, or Firm* — Goodwin Procter LLP

(57) ABSTRACT

A device for making frozen geometric shapes, more particularly, to an ice molding device that shapes ice is disclosed. According to one embodiment, a device comprises a lower chamber of an ice shaping device and a plurality of guide-posts on the lower chamber. The device further comprises a semi-spherical cavity in the lower chamber and a hole to fill a hollow chamber of the lower chamber with hot water.

13 Claims, 5 Drawing Sheets

ICE SHAPING DEVICE

CROSS-REFERENCE TO RELATED APPLICATIONS

The present application claims the benefit of and priority to U.S. Provisional Application No. 62/674,272, filed May 21, 2018, entitled "ICE SHAPING DEVICE" which is herein incorporated by reference in its entirety.

TECHNICAL FIELD

The present invention relates to a device for making frozen geometric shapes, more particularly, to an ice molding device that shapes ice, such as shaping an ice block into an ice sphere or ice ball.

BACKGROUND

Ice molds and devices that shape ice into frozen geometric shapes, such as an ice sphere or an ice ball, are commonly used to make ice spheres to cool beverages such as alcoholic drinks. Spherically shaped ice is desirable for use in cooling beverages, as ice spheres can help keep drinks colder for longer, can help preserve the flavor of the drink, and can help slow the melting of the ice preventing dilution of the beverage, while cooling the beverage.

Conventional ice molds for creating ice spheres are generally made of a flexible material, such as silicone rubber, which presents difficulties such as requiring a long period of time to shape ice spheres by waiting for water to freeze. The ice also can become stuck to the ice mold, making it difficult to remove the ice from the mold while keeping the spherical shape intact.

More recently, ice sphere pressing devices solve this problem by evenly melting already frozen blocks of ice into a desired shape. In general, such a device operates by placing a block of ice on the bottom half of the press and then placing the top half of the press on top of the block of ice. The top half of the press then lowers by gravitational force, eventually connecting with the bottom half, shaping the ice block into an ice sphere. The ice press accomplishes this by transferring room temperature heat from the metallic press to aid in melting the ice to allow for shaping, while the top half lowers on its own due its weight and gravitational forces.

Currently available ice sphere press devices are made of heavy metals and are expensive, making them difficult to handle and expensive to ship. These devices also rely on room temperature and gravity, lacking any sort of internal heating function to speed the process of shaping the ice into a sphere.

SUMMARY

A device for making frozen geometric shapes, more particularly, to an ice molding device that shapes ice is disclosed. According to one embodiment, a device comprises a lower chamber of an ice shaping device and a plurality of guideposts on the lower chamber. The device further comprises a semi-spherical cavity in the lower chamber and a hole to fill a hollow chamber of the lower chamber with hot water.

Other features and advantages will become apparent from the following detailed description, taken in conjunction with the accompanying drawings, which illustrate by way of example, the features of the various embodiments.

BRIEF DESCRIPTION OF THE DRAWINGS

The foregoing will be apparent from the following more particular description of example embodiments of the invention, as illustrated in the accompanying drawings.

Figure 1:
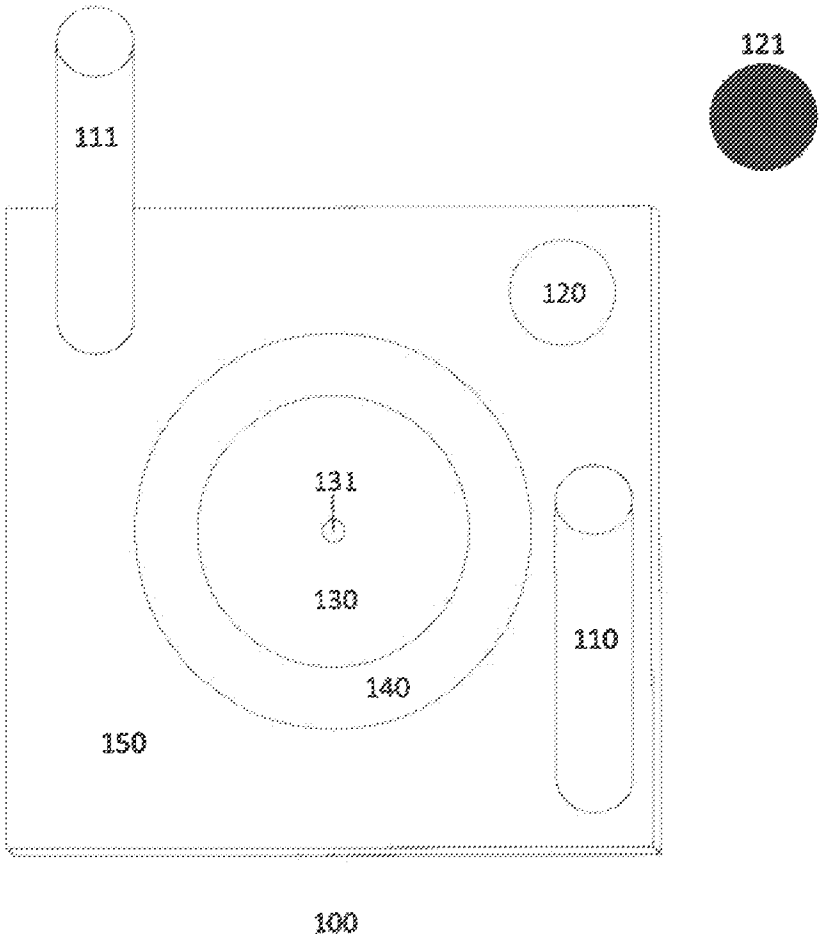
FIG. 1 depicts a top view of the lower half of an ice shaping device, according to one embodiment.

It should be noted that the figures are not necessarily drawn to scale and elements of similar structures or functions are generally represented by like reference numerals for illustrative purposes throughout the figures. It also should be noted that the figures are only intended to facilitate the description of the various embodiments described herein. The figures do not describe every aspect of the teachings disclosed herein and do not limit the scope of the claims.

DETAILED DESCRIPTION

The following disclosure provides many different embodiments, or examples, for implementing different features of the subject matter. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

A device for making frozen geometric shapes, more particularly, to an ice molding device that shapes ice is disclosed. According to one embodiment, a device comprises a lower chamber of an ice shaping device and a plurality of guideposts on the lower chamber. The device further comprises a semi-spherical cavity in the lower chamber and a hole to fill a hollow chamber of the lower chamber with hot water.

FIG. 1 depicts a top view of the lower half of an ice shaping device, lower chamber 100, according to one embodiment. In certain embodiments, the components of the lower chamber 100 are made out of lightweight metals, such as stainless steel, allowing for easy handling, while retaining the same functionality as other devices that are commonly made of heavier, more expensive metals.

As shown in FIG. 1, in one embodiment, the lower chamber 100 serves as the lower half of the ice shaping device, and has two guideposts 110 and 111. In certain embodiments, at the top of lower chamber 100, there is a semi-spherical cavity 130 with a slightly raised portion 140 surrounding the cavity. In certain embodiments, a pin-sized hole 131 at the bottom of semi-spherical cavity 130 allowing for melted ice water to drain.

In another embodiment, the lower chamber 100 can have a circular hole 120, which can be used to fill the hollow chamber 150 with hot water at boiling temperatures, and in certain embodiments, water up to temperatures of 140° F. The hot water can be added into circular hole 120 on the top surface of lower chamber 100. The hot water surrounds semi-spherical cavity 130 and can promote ice shaping. Cap 121 securely encloses the top of the circular hole 120 to prevent hot water from leaking. In certain embodiments, the heat of the hot water transfers to the metal of lower chamber 100, promoting shaping of the ice to occur more rapidly.

According to one embodiment, lower chamber 100 measures 140 mm wide by 140 mm deep by 110 mm high. The diameter of the inner semi-spherical cavity 130 is 70 mm.

Figure 2:
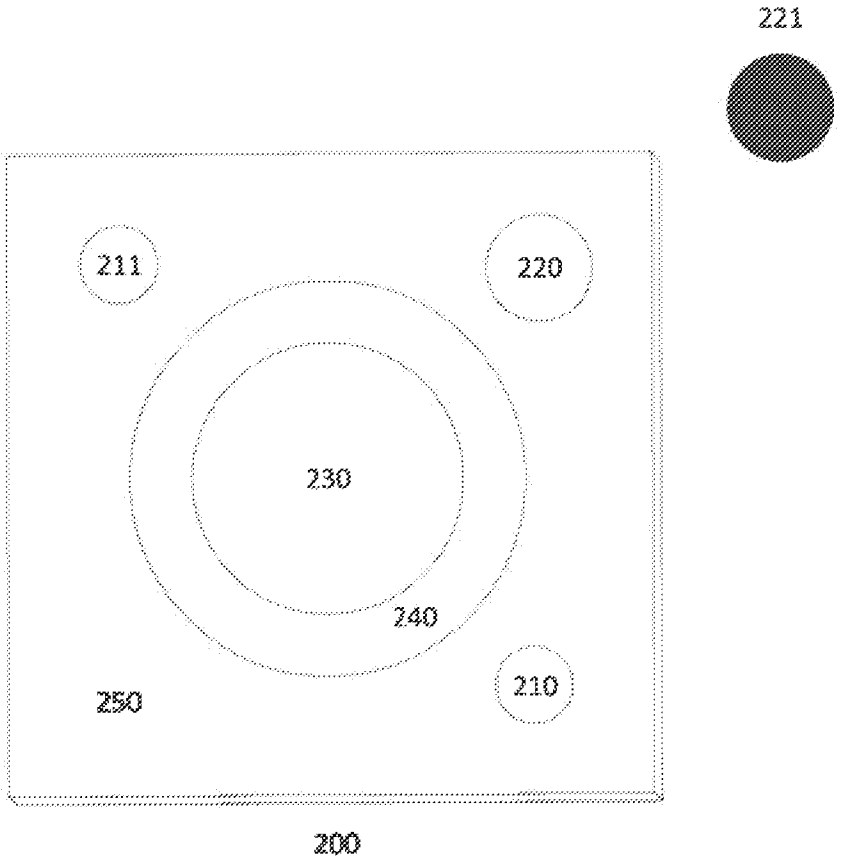
FIG. 2 depicts a top view of the upper half of an ice shaping device, according to one embodiment.

FIG. 2 depicts a top view of the upper half of an ice shaping device, upper chamber 200, according to one embodiment. In certain embodiments, the components of the upper chamber 200 are made out of lightweight metals, such as stainless steel, allowing for easy handling, while retaining the same functionality as other devices that are commonly made of heavier, more expensive metals.

As shown in FIG. 2, the upper chamber 200 serves as the upper half of the ice shaping device, having two circular openings 210 and 211 that align with and fit into guideposts 110 and 111 of the lower half. At the bottom of upper chamber 200, there is a semi-spherical cavity 230 with a slightly indented portion 240 surrounding the cavity 230, allowing for the upper chamber 200 to make a tight fit with lower chamber 100 when the ice shaping device is in the closed position.

In another embodiment, the upper chamber 200 can have a circular hole 220, which can be used to fill the hollow chamber 250 with hot water at boiling temperatures, and in certain embodiments, water up to temperatures of 140° F. The hot water can be added into circular hole 220 on the top surface of upper chamber 200. The hot water surrounds semi-spherical cavity 230 and can promote ice shaping. Cap 221 securely encloses the top of the circular hole 220 to prevent hot water from leaking. In certain embodiments, the heat of the hot water transfers to the metal of lower chamber 200, promoting shaping of the ice to occur more rapidly.

According to one embodiment, upper chamber 200 measures 140 mm wide by 140 mm deep by 110 mm high. The diameter of the inner semi-spherical cavity 230 is 70 mm.

Figure 3:
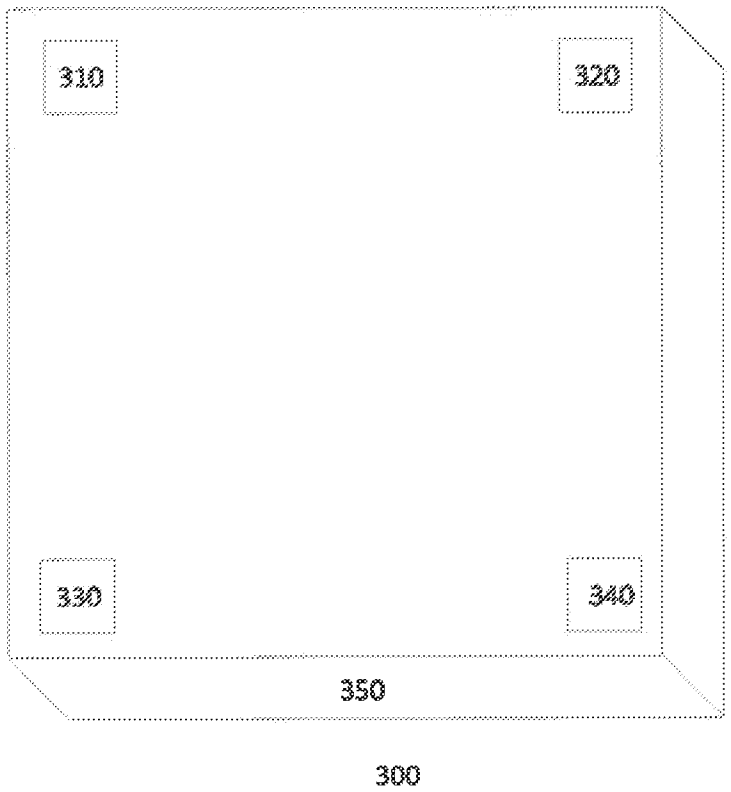
FIG. 3 depicts a side view of a drip tray base of an ice shaping device, according to one embodiment.

FIG. 3 depicts a top view of a drip tray base 300 of the ice shaping device, according to one embodiment. In certain embodiments, drip tray 300 serves as the base to the ice shaping device, surrounding and securing the ice shaping device, and collecting excess water that leaks during the shaping process. Drip tray 300 can have supportive inserts 310, 320, 330, and 340 in each of its four corners, allowing the tray to more securely support the ice shaping device, and preventing the ice shaping device from tipping over. In certain embodiments, drip tray 300 has an open top with raised walls 350 to collect melted ice water.

Figure 4:
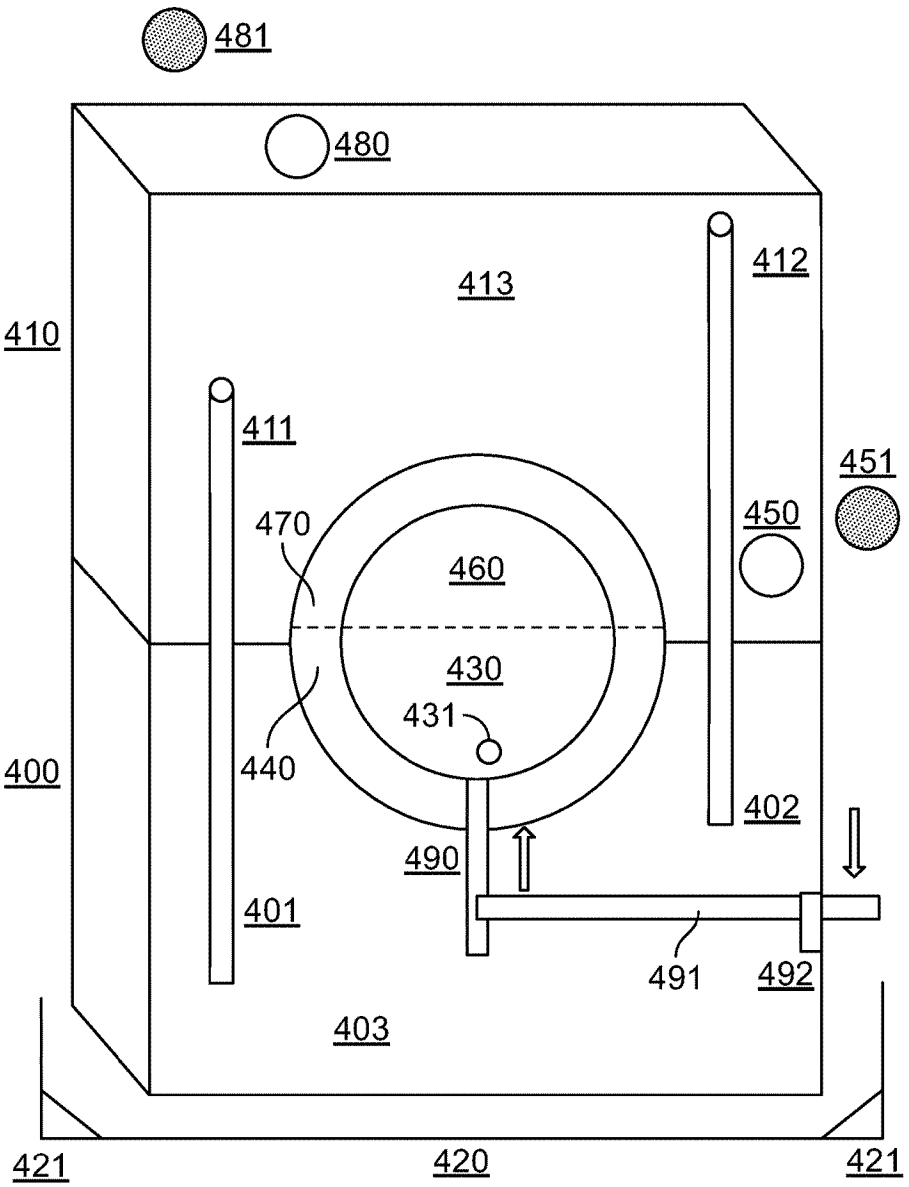
FIG. 4 depicts a front view of an ice shaping device with an upper half on top of a lower half in a closed position, according to one embodiment.

FIG. 4 depicts a front view of the ice shaping device, including lower chamber 400, upper chamber 410, and drip tray 420, according to one embodiment. The ice shaping device is depicted in a closed position, meaning the upper chamber 410 has lowered to fit directly on top of lower chamber 400, thus completing the ice shaping process of generating an ice sphere or ice ball.

As shown in FIG. 4, lower chamber 400 is resting on top of drip tray 420, secured by supports 421 to stabilize the device. Lower chamber 400 has two guideposts, 401 and 402, which fit into the circular openings 411 and 412 of upper chamber 410, and the device is in a closed position when the guideposts are fully inserted into the circular openings.

In one embodiment, lower chamber 400 serves as the lower half of the ice shaping device, having two guideposts 401 and 402. At the top of lower chamber 400, there is a semi-spherical cavity 430 with a slightly raised portion 440 surrounding the cavity 430, allowing for the lower chamber 400 to make a tight fit with upper chamber 410. Semi-spherical cavity 430 can also have a pin-sized hole 431 at the bottom of semi-spherical cavity 430 allowing for melted ice water to drain.

In another embodiment, the lower chamber 400 can have a circular hole 450, which can be used to fill the hollow chamber 403 with hot water at boiling temperatures, and in certain embodiments, water up to temperatures of 140° F. The hot water can be added into circular hole 450 on the top surface of lower chamber 400. The hot water surrounds semi-spherical cavity 430 and can promote ice shaping. Cap 451 securely encloses the top of the circular hole 450 to prevent hot water from leaking. In certain embodiments, the heat of the hot water transfers to the metal of lower chamber 400, promoting shaping of the ice to occur more rapidly as the upper chamber 410 travels downwards by gravitational force.

In another embodiment, an upper chamber 410 serves as the top half of the ice shaping device, having two circular openings 411 and 412 that align with and fit into guideposts 401 and 402, respectively, of the lower chamber 400. At the bottom of upper chamber 410, there is a semi-spherical cavity 460 with a slightly raised portion 470 surrounding the cavity 460, allowing for the lower chamber 400 to make a tight fit with upper chamber 410.

In another embodiment, the upper chamber 410 can have a circular hole 480, which can be used to fill the hollow chamber 413 with hot water at boiling temperatures, and in certain embodiments, water up to hot tap water (e.g., temperatures of 140° F.). The hot water can be added into circular hole 480 on the top surface of upper chamber 410. The hot water surrounds semi-spherical cavity 460 and can promote ice shaping. Cap 481 securely encloses the top of the circular hole 480 to prevent hot water from leaking. In certain embodiments, the heat of the hot water transfers to the metal of lower chamber 200, promoting shaping of the ice to occur more rapidly as the upper chamber 410 travels downwards by gravitational force.

In another embodiment, an internal electronic heating element heats and/or maintains the temperature of lower chamber 400 and upper chamber 410. The internal electronic heating element operates such that the lower chamber 400 and upper chamber 410 do not need to be drained and refilled with hot water to facilitate the shaping of the ice ball.

In certain embodiments, a drip tray 420 serves as the base to the ice shaping device, surrounding and securing lower chamber 400, and collecting excess water that may leak during the shaping process. Drip tray 420 can have supportive inserts 421 in each of its four corners, allowing the tray to more securely support lower chamber 400 and preventing the ice shaping device from tipping over.

In another embodiment, a push-up rod 490 allows for easy release to remove the finished ice sphere from semi-spherical cavity 430. A lever 491 is connected to push-up rod 490, protruding from a slit 492 in lower chamber 400. Pushing down on lever 491 causes the push-up rod 490 to move upward, allowing for easy removal of the finished ice sphere from the ice shaping device.

In another embodiment, the ice shaping device includes a valve to allow water to drain out of the ice shaping device and into the drip tray. The valve may also be configured (e.g., threaded, pressure fit, etc.) to connect to a drain pipe or tube. Valves may be located on both the top and bottom halves of the ice shaping device.

Figure 5:
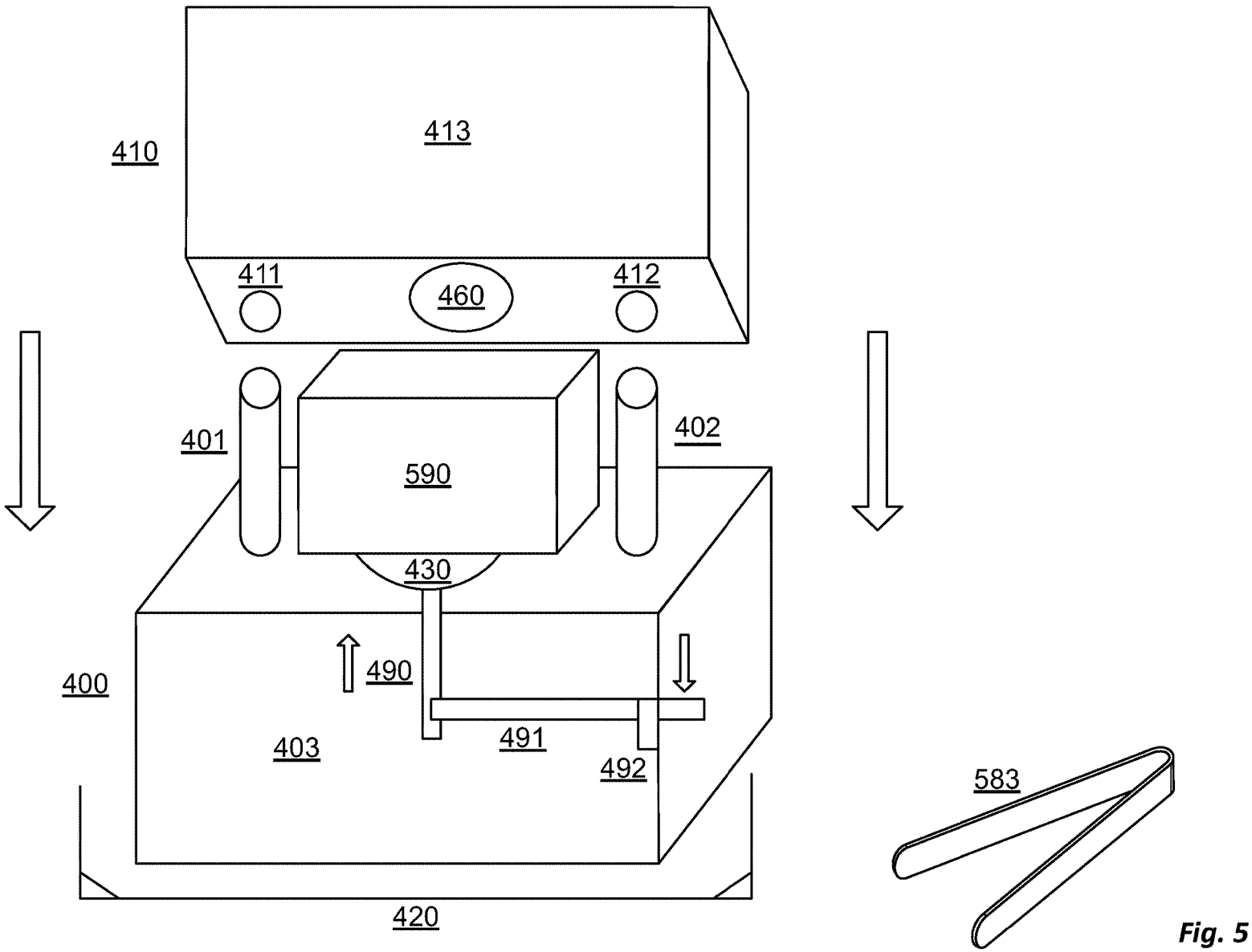
FIG. 5 depicts a front view of an ice shaping device with an upper half slightly above a lower half, according to one embodiment.

FIG. 5 depicts an alternate view of the ice shaping device, including lower chamber 400, upper chamber 410, and drip tray 420, according to one embodiment. The ice shaping device is shown in an open position, meaning the upper chamber 410 is just above the lower chamber 400, and an ice block 590 is located between the two chambers.

As shown in FIG. 5, upper chamber 410 is positioned above guideposts 401 and 402, which are protruding from lower chamber 400, and are aligned with circular openings 411 and 412. In certain embodiments, lower hollow chamber 403 and upper hollow chamber 413 have been filled with hot water, warming the device, and transferring the heat to allow for the ice block to melt and become easier to shape. As gravitational forces encourage the upper chamber 410 to travel down along the guideposts 401 and 402, the ice block 590 continues melting, and the ice block begins to change shape, conforming to the rounded shape of semispherical cavity 430 and semi-spherical cavity 460. Excess water from the melting ice is collected by drip tray 420.

Once the ice shaping device has reached the closed position (see FIG. 4), the upper chamber 410 can be raised along guideposts 401 and 402, removed, and set aside. In another embodiment, a push-up rod 490 allows for easy release to remove the finished ice sphere from semi-spherical cavity 430. A lever 491 is connected to push-up rod 490, protruding from a slit 492 in lower chamber 400. Pushing down on lever 491 causes the push-up rod 490 to move upward, allowing for easy removal of the finished ice sphere from the ice shaping device. The ice block has now been shaped into an ice sphere or ice ball, which in certain embodiments, can be easily removed from lower chamber 400 using ice tong 583.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated.

What is claimed is:

1. An ice-shaping device, comprising:

a lower chamber comprising:

a plurality of outer walls defining a hollow interior in the lower chamber, wherein the plurality of outer walls comprises a top wall defining:

a lower semi-spherical cavity;

a drain hole at a bottom of the lower semi-spherical cavity that allows melted ice water to drain; and a hole separated laterally from and outside of the lower semi-spherical cavity and providing access to the hollow interior in the lower chamber; and a plurality of guideposts, wherein the hollow interior in the lower chamber extends to each wall from the plurality of outer walls; and an upper chamber comprising:

a plurality of exterior walls defining a hollow interior the upper chamber, wherein the plurality of exterior walls comprises a bottom wall defining:

an upper semi-spherical cavity; and a plurality of openings that align with and fit on the plurality of guideposts of the lower chamber, and wherein the plurality of exterior walls further comprises an upper wall defining a hole providing access to the hollow interior in the upper chamber, wherein the hollow interior in the upper chamber extends to each wall from the plurality of exterior walls, wherein each guidepost from the plurality of guideposts has a length greater than or equal to a diameter of the lower semi-spherical cavity and the upper semi-spherical cavity, wherein the bottom wall in the upper semi-spherical cavity is continuous, and wherein the top wall in the lower semi-spherical cavity is continuous other than the drain hole.

2. The ice-shaping device of claim 1, further comprising a drip tray that collects excess water generated when shaping ice.

3. The ice-shaping device of claim 2, wherein the drip tray further comprises supportive inserts to secure the lower chamber.

4. The ice-shaping device of claim 1, further comprising a push-up rod that releases shaped ice from the lower semi-spherical cavity.

5. The ice-shaping device of claim 4, further comprising a lever connected to the push-up rod that when lowered causes the push-up rod to release the shaped ice from the lower semi-spherical cavity.

6. The ice-shaping device of claim 1, wherein the top wall defines a raised portion surrounding the lower semi-spherical cavity, and wherein the bottom wall defines an indented portion surrounding the upper semi-spherical cavity.

7. The ice-shaping device of claim 6, wherein the raised portion comprises a raised ring around a perimeter of the lower semi-spherical cavity, and wherein the indented portion comprises an indented ring around a perimeter of the upper semi-spherical cavity.

8. The ice-shaping device of claim 1, further comprising a first cap to cover the hole in the top wall.

9. The ice-shaping device of claim 8, further comprising a second cap to cover the hole in the upper wall.

10. The ice-shaping device of claim 1, wherein the upper chamber is configured to be lowered and raised along the plurality of guideposts.

11. The ice-shaping device of claim 1, wherein the plurality of outer walls and the plurality of exterior walls are made of metal.

12. The ice-shaping device of claim 1, wherein the guideposts are on the top wall.

13. The ice-shaping device of claim 1, wherein the hollow interior in the upper chamber surrounds the upper semi-spherical cavity, and wherein the hollow interior in the lower chamber surrounds the lower semi-spherical cavity.

* * * * *